US006301913B1

(12) United States Patent
Schulak et al.

(10) Patent No.: US 6,301,913 B1
(45) Date of Patent: Oct. 16, 2001

(54) ANTI-SWEAT HEATER IMPROVEMENT FOR COMMERCIAL REFRIGERATION

(75) Inventors: Edward R. Schulak, 567 Aspen, Birmingham, MI (US) 48009; Roland Ares, St. Charles, MO (US)

(73) Assignee: Edward R. Schulak, Birmingham, MI (US)

( * ) Notice: Subject to any disclaimer, the term of this patent is extended or adjusted under 35 U.S.C. 154(b) by 0 days.

(21) Appl. No.: 09/567,286

(22) Filed: May 8, 2000

(51) Int. Cl.[7] ..... A47F 3/04
(52) U.S. Cl. ..... 62/248; 62/277
(58) Field of Search ..... 62/248, 277

(56) References Cited

U.S. PATENT DOCUMENTS

| | | | | |
|---|---|---|---|---|
| 1,774,374 | * | 8/1930 | Horton | 62/248 |
| 2,651,187 | * | 9/1953 | Harris et al. | 62/277 |
| 4,127,765 | | 11/1978 | Heaney | 219/218 |
| 4,341,089 | | 7/1982 | Ibrahim et al. | 62/246 |
| 4,389,856 | * | 6/1983 | Ibrahim | 62/248 |
| 4,548,049 | | 10/1985 | Rajgopal | 62/275 |
| 4,658,553 | | 4/1987 | Shinagawa | 52/172 |
| 5,542,258 | | 8/1996 | Shim | 62/80 |
| 5,921,092 | * | 7/1999 | Behr et al. | 62/277 |

* cited by examiner

*Primary Examiner*—William E. Tapolcai
(74) *Attorney, Agent, or Firm*—Harness, Dickey & Pierce, P.L.C.

(57) ABSTRACT

A refrigerator unit is provided including a casing having a plurality of walls, one of the walls including an opening on one side thereof. A glass door is pivotally attached to the casing for covering the opening. A first warm fluid passage is provided extending along at least a portion of the opening in the casing. A second warm fluid passage extends along a portion of the door along a perimeter thereof where the door engages the casing. The refrigeration system includes a compressor, condenser, expansion valve, and an evaporator connected in series. The refrigerant condensing section has a liquid cooling system wherein the first fluid passage is the refrigerant and the second fluid passage provides the liquid from the liquid cooling system.

10 Claims, 2 Drawing Sheets

ANTI-SWEAT HEATER IMPROVEMENT FOR COMMERCIAL REFRIGERATION

FIELD OF THE INVENTION

The present invention relates generally to refrigeration systems, and more particularly to commercial refrigeration systems having anti-sweat heating by use of warm fluid circulated in tubing embedded in the frame of the glass door and along the cabinet's door opening area.

BACKGROUND

Currently, refrigerated product storage and display cases which are used in supermarkets are typically provided with a door structure having a multi-paned window which is surrounded by a metallic door frame. To prevent condensation and frost from forming on the door frame, it is known in the art to provide electrical heating elements concealed within a groove at the outer edges of the door or within the door frame of the display case. The electric heater strips raise the surface dew point temperature so that condensate droplets do not form on the surface of the metal surfaces. Each time the door is opened, room ambient air or warmer, humid air tends to enter the refrigerated space, or when the door is closed, the door gasket may leak cold air which can cause the door frame and its jam to condense ambient condensate. The condensate can freeze to form frost or drip downwards onto the floor. The use of electric heater strips embedded in the door, primarily at the area of the door gasket seal has been utilized in order to reduce the formation of condensate. The electric heater strips either operate continually or are controlled by an enthalpy monitoring controller whereas they cycle based on the relative humidity relative to the ambient dry bulb temperature, i.e., dew point. Most supermarkets tend to leave these heaters on continuously in the summer because of the potential liability of having a wet floor in the shopping aisle. Having the heaters on also eliminates the frosted glass effect a high door opening rate has on moisture entering into the display case. The added cost of the door heater operation is rationalized by these factors. However, it is still desirable to provide a more efficient, less costly method of preventing condensate from forming on the door frame and the door jam.

SUMMARY OF THE INVENTION

In light of the above, it is an object of the present invention to provide an anti-sweat heating system for commercial refrigeration that reduces energy and requirements.

It is still another object of the present invention to provide an anti-sweat heating system for a commercial refrigeration cabinet which utilizes an existing heat source for heating a fluid which is used to warm the door frame and door jam of a refrigeration cabinet.

These and other objects of the present invention are obtained by providing a refrigeration unit, including a casing having a plurality of walls, one of the walls including an opening on one side thereof. A door is pivotally attached to the casing for covering the opening. A first warm fluid passage is provided extending along at least a portion of the opening in the casing. A second warm fluid passage extends along a portion of the door along a perimeter thereof where the door engages the casing. The refrigeration system includes a compressor, condenser, expansion valve, and an evaporator connected in series. The condensing unit section has a liquid cooling system wherein the first and second fluid passages are provided with liquid from the liquid cooling system.

The door is provided with a gasket which engages the casing, the second warm fluid passage is disposed adjacent to the door gasket. The second warm fluid passage includes a fluid coupling which extends along a pivot axis of the door.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
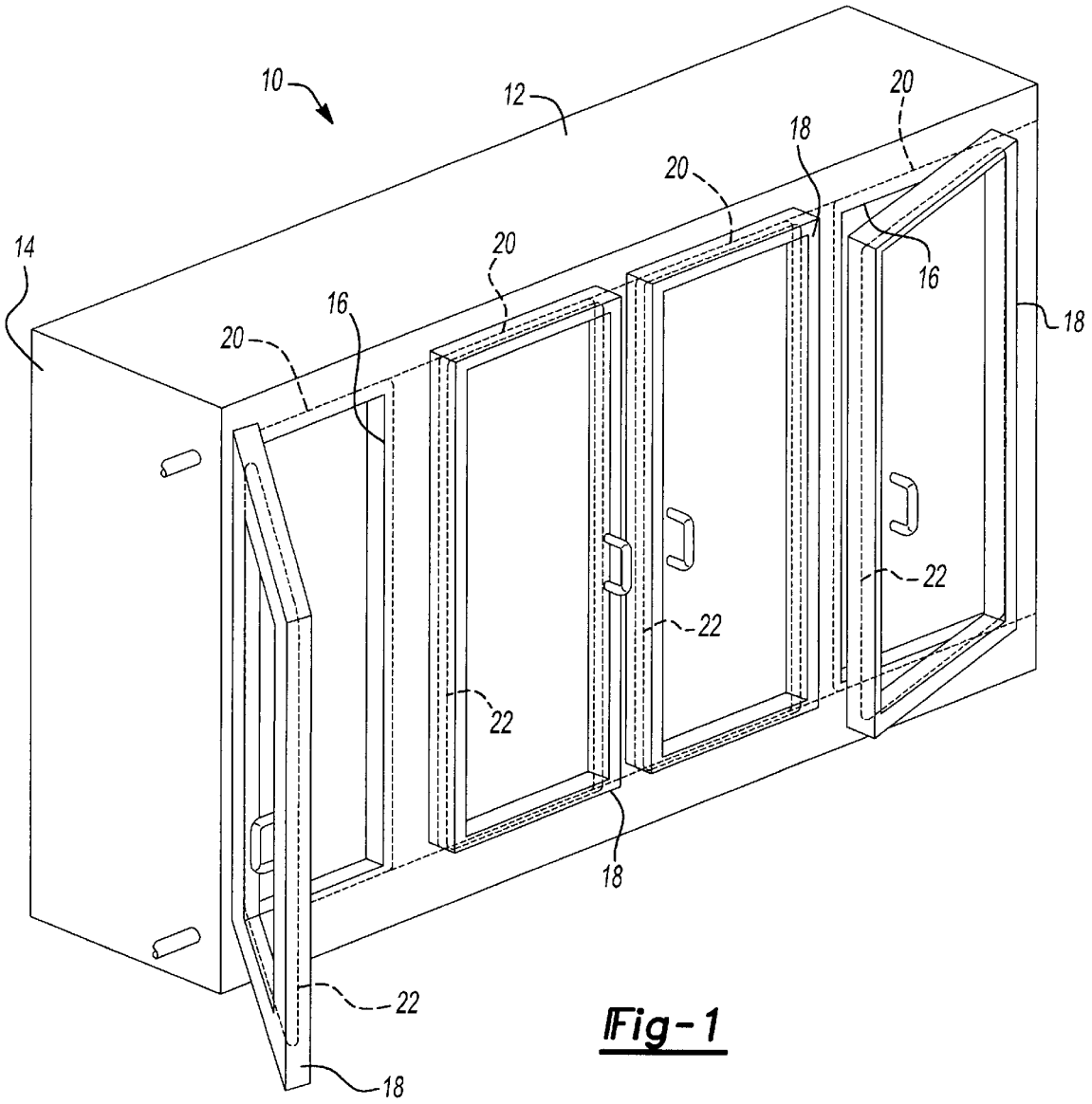
FIG. 1 is a perspective view of a refrigerated product storage and display case according to the principles of the present invention.

With reference to FIGS. 1 through 6, the anti-sweat heater system for commercial refrigeration units according to the present invention will now be described. FIG. 1 illustrates a typical supermarket style refrigerated product storage and display case 10. The refrigerated display case 10 includes a casing 12 which includes a plurality of walls 14. The front wall is provided with a plurality of openings 16 which allow access to the products stored therein. A plurality of doors 18 are pivotally mounted to the casing 12 for covering the openings 16. According to the principles of the present invention, warm fluid passages 20 are provided in the door jam surrounding the openings 16. A second set of warm fluid passages 22 are provided in each of the doors 18.

Figure 2:
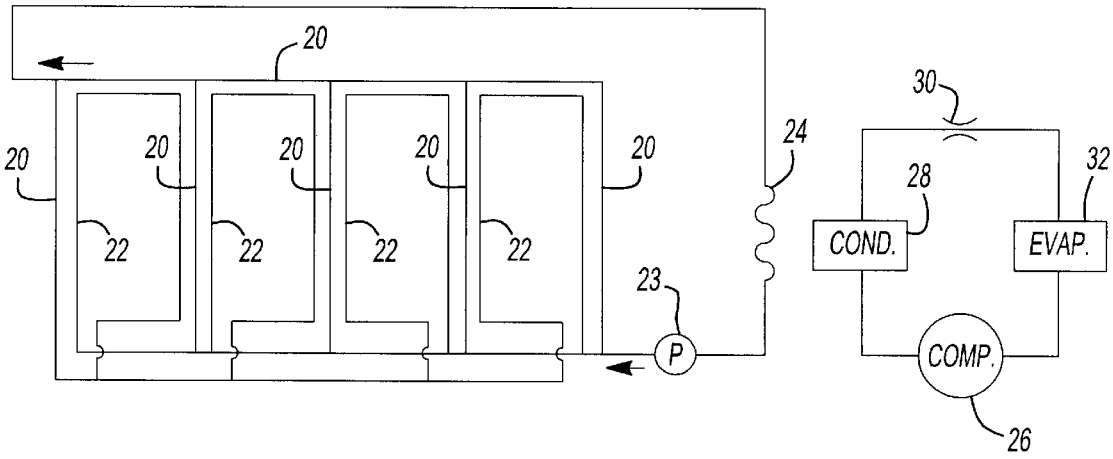
FIG. 2 is a schematic illustration of the warm fluid passages which are provided through the door and door jam portions of the refrigerated display case according to the principles of the present invention.
Figure 3:
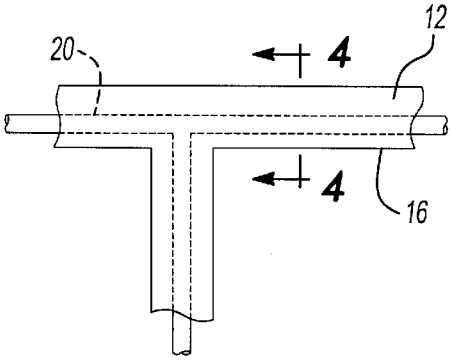
FIG. 3 illustrates the location of the warm fluid passages in the door jam of the refrigerated display according to the principles of the present invention.
Figure 4:
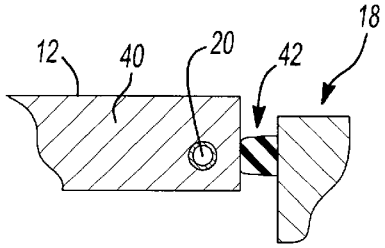
FIG. 4 is a partial cross-sectional view illustrating the location of the warm fluid passage in the door jam according to the principles of the present invention.
Figure 5:
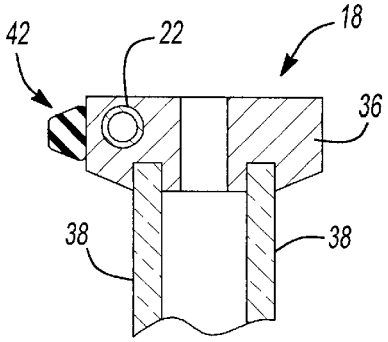
FIG. 5 is a cross-sectional view illustrating the location of the warm fluid passage provided in the door according to the principles of the present invention.

With reference to FIG. 2, the first and second fluid passages 20, 22 are shown laid out in an exemplary fashion. A pump 23 is provided for pumping the fluid through the first and second fluid passages 20, 22. The warm secondary fluid passages communicate within the refrigerant liquid cooling condensing section, which provides cooling for the condenser 28, and is possibly cooling within the compressor 26 of a refrigerant system, having an expansion valve 30 and evaporator 32, as is well known in the art. The warmed fluid which is utilized to cool the condensing section is then utilized to provide warming within the conduits placed in the door frame in the area of the gaskets for the specific purpose of spot containment heating, with no outward radiation intended.

The warm fluid passages are preferably defined by tubes or molded passages contained within the door jam portion surrounding the openings 16 in the casing 12. The warm fluid passages 22 are also preferably in the form of tubes which are placed in the glass door's outer frame 36, that frames the glass panels 38. The tubes 20 which are implanted within the casing 12 are insulated from the interior space as shown by insulation 40, best shown in FIG. 4. The warm fluid passages 20 are preferably provided along the area where the door jam interfaces with the gasket 42 of the door 18.

Figure 6:
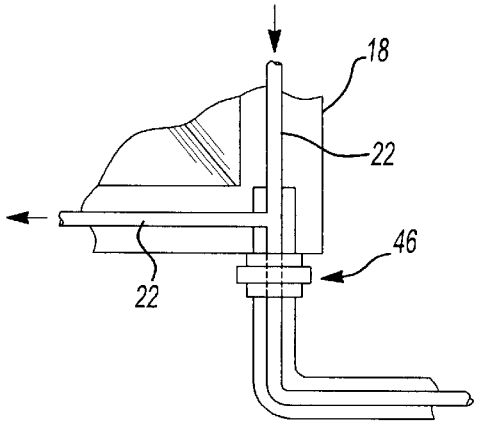
FIG. 6 illustrates a fluid coupling which is provided for delivering fluid to the warm fluid passage provided in the door of the refrigerated display case according to the principles of the present invention.

Each of the doors 18 are pivotally mounted to the casing 12. Flexible connectors can be utilized as an input and an output to the passage in the doors. The flexible connectors are allowed to bend to accommodate opening and closing of the doors. According to another embodiment, the fluid passages 22 which are provided in the doors 18 are each provided with a fluid coupling 46 which extends along the pivot axis of the doors 18, as best shown in FIG. 6. The fluid coupling 46 includes an outlet passage 48 which is disposed within and concentric with an inlet passage 50. Warm secondary fluid is passed through the door and jam in a parallel flow arrangement. A multi-door case array would feature duplication of the door and jam parallel flow concept.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A refrigerator unit, comprising:

a casing having a plurality of walls, one of said wall including an opening on one side thereof;

a door pivotally attached to said casing for covering said opening;

a first warm fluid passage in said one of said walls and extending along at least a portion of said opening;

a second warm fluid passage extending along at least a portion of said door along a perimeter thereof where said door engages said casing;

wherein said second warm fluid passage is in continuous heat transfer communication when said door is in an open position and when said door is in a closed position.

2. The refrigerator unit according to claim 1, further comprising a refrigeration system including a compressor, condenser, expansion valve and an evaporator connected in series, said condensing section having a liquid cooling system, wherein said first fluid passage is refrigerant and said second fluid passage provides the liquid from said liquid cooling system.

3. The refrigerator unit according to claim 1, wherein said door is provided with a door gasket which engages said casing, said second warmed fluid passage being disposed adjacent to said door gasket.

4. The refrigerator unit according to claim 1, wherein said second warm fluid passage includes a fluid coupling which extends along a pivot axis of said door.

5. The refrigerator unit according to claim 1, wherein said casing includes a plurality of openings, each of said openings having a door pivotally mounted adjacent thereto, wherein each of said doors has a warm fluid passage extending along at least a portion of said door along a perimeter thereof where said door engages said casing.

6. A refrigerator unit, comprising:

a casing having a plurality of walls, one of said wall including an opening on one side thereof;

a door pivotally attached to said casing for covering said opening;

a warm fluid passage extending along at least a portion of said door along a perimeter thereof where said door engages said casing;

wherein said warm fluid passage is in continuous heat transfer communication when said door is in an open position and when said door is in a closed position.

7. The refrigerator unit according to claim 6, further comprising a refrigeration system including a compressor, condenser, expansion valve and an evaporator connected in series, said condensing section having a liquid cooling system, wherein said warm fluid passage is provided with liquid from said liquid cooling system.

8. The refrigerator unit according to claim 6, wherein said door is provided with a door gasket which engages said casing, said warm fluid passage being disposed adjacent to said door gasket.

9. The refrigerator unit according to claim 6, wherein said warm fluid passage includes a fluid coupling which extends along a pivot axis of said door.

10. The refrigerator unit according to claim 6, wherein said casing includes a plurality of openings, each of said openings having a door pivotally mounted adjacent thereto, wherein each of said doors has a warm fluid passage extending along at least a portion of said door along a perimeter thereof where said door engages said casing.

* * * * *